US011651778B2

(12) United States Patent
Lim et al.

(10) Patent No.: US 11,651,778 B2
(45) Date of Patent: May 16, 2023

(54) METHODS OF ENCODING AND DECODING AUDIO SIGNAL, AND ENCODER AND DECODER FOR PERFORMING THE METHODS

(71) Applicant: ELECTRONICS AND TELECOMMUNICATIONS RESEARCH INSTITUTE, Daejeon (KR)

(72) Inventors: Woo-taek Lim, Sejong-si (KR); Seung Kwon Beack, Daejeon (KR); Jongmo Sung, Daejeon (KR); Tae Jin Lee, Daejeon (KR); Inseon Jang, Daejeon (KR); Jong-Won Seok, Changwon-si (KR); Yunsu Kim, Changwon-si (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 17/520,895

(22) Filed: Nov. 8, 2021

(65) Prior Publication Data

US 2022/0375483 A1 Nov. 24, 2022

(30) Foreign Application Priority Data

May 24, 2021 (KR) ..... 10-2021-0066131

(51) Int. Cl.
*G10L 19/16* (2013.01)
*G10L 19/02* (2013.01)
(Continued)

(52) U.S. Cl.
CPC ..... *G10L 19/038* (2013.01); *G10L 19/02* (2013.01); *G10L 19/167* (2013.01); *G10L 25/30* (2013.01)

(58) Field of Classification Search
CPC ..... G10L 19/167; G10L 19/02; G10L 25/30
See application file for complete search history.

(56) References Cited

U.S. PATENT DOCUMENTS 10,777,212 B2 9/2020 Lee et al.
2016/0099005 A1 4/2016 Liljeryd et al.
(Continued)

OTHER PUBLICATIONS

Zhao, Z., Liu, H., & Fingscheidt, T. (2018). Convolutional neural networks to enhance coded speech. IEEE/ACM Transactions on Audio, Speech, and Language Processing, 27(4), 663-678.*
(Continued)

*Primary Examiner* — Bryan S Blankenagel
(74) *Attorney, Agent, or Firm* — LRK Patent Law Firm

(57) ABSTRACT

Disclosed are methods of encoding and decoding an audio signal, and an encoder and a decoder for performing the methods. The method of encoding an audio signal includes identifying an input signal corresponding to a low frequency band of the audio signal, windowing the input signal, generating a first latent vector by inputting the windowed input signal to a first encoding model, transforming the windowed input signal into a frequency domain, generating a second latent vector by inputting the transformed input signal to a second encoding model, generating a final latent vector by combining the first latent vector and the second latent vector, and generating a bitstream corresponding to the final latent vector.

5 Claims, 10 Drawing Sheets

(51) Int. Cl.
*G10L 25/30* (2013.01)
*G10L 19/038* (2013.01)

(56) References Cited

U.S. PATENT DOCUMENTS

| | | | | |
|---|---|---|---|---|
| 2018/0068667 | A1 | 3/2018 | Lee et al. | |
| 2020/0046244 | A1* | 2/2020 | Alam | A61B 5/349 |
| 2020/0234725 | A1* | 7/2020 | Garbacea | G06N 3/08 |
| 2021/0407526 | A1* | 12/2021 | Xiao | G10L 19/0204 |

OTHER PUBLICATIONS

Zhen, K., Sung, J., Lee, M. S., Beak, S., & Kim, M. (2021). Scalable and Efficient Neural Speech Coding. arXiv preprint arXiv: 2103. 14776.*

Pramod Bachhav, et al., "Latent representation learning for artificial bandwidth extension using a conditional variational auto-encoder." ICASSP 2019-2019 IEEE International Conference on Acoustics, Speech and Signal Processing (ICASSP). IEEE, 2019.

Konstantin Schmidt, et al., "Blind bandwidth extension based on convolutional and recurrent deep neural networks." 2018 IEEE International Conference on Acoustics, Speech and Signal Processing (ICASSP). IEEE, 2018.

Volodymyr Kuleshov, et al., Audio Super-Resolution Using Neural Nets, ICLR2017.

* cited by examiner

METHODS OF ENCODING AND DECODING AUDIO SIGNAL, AND ENCODER AND DECODER FOR PERFORMING THE METHODS

CROSS-REFERENCE TO RELATED APPLICATION

This application claims the benefit of Korean Patent Application No. 10-2021-0066131 filed on May 24, 2021, in the Korean Intellectual Property Office, the entire disclosure of which is incorporated herein by reference for all purposes.

BACKGROUND

1. Field of the Invention

One or more example embodiments relate to methods of encoding and decoding an audio signal, and an encoder and a decoder for performing the methods, and more particularly, to a technique for enhancing an audio quality by restoring a high-band signal based on a low-band signal.

2. Description of Related Art

Audio coding technology has been continuously developed, and in recent years, Unified Speech and Audio Coding (USAC), the 4th-generation MPEG audio coding technology, has been increasingly utilized. However, in order to provide high audio quality, Advanced Audio Coding (AAC), the second-generation MPEG audio coding technology, is still used.

In audio coding technology, an efficient compression ratio and high quality restoration are important. To this end, for efficient compression in encoding an audio signal, a compression rate may be increased by minimizing or eliminating an audio signal of a high frequency band that is difficult for humans to perceive, but high-quality restoration may be difficult with minimal information. Accordingly, there is a demand for a technique for replicating a high frequency band identically to the original audio signal.

In expanding an audio signal of a low frequency band, G.729.1 and spectral band replication (SBR) are currently the most widely used band extension techniques. The above techniques encode a low frequency band of an audio signal using the existing codec and approximately encode a high frequency band of the audio signal using fewer parameters. These bandwidth extension algorithms use a correlation between the low frequency band and the high frequency band to predict an audio signal of a high frequency band from extracted features of the audio signal in a low frequency band.

When an audio encoder is operated using SBR, an operation area of the low frequency band is different from a quadrature mirror filter (QMF) domain of the high frequency band. Thus, two types of transformations are required in the encoding process, resulting in an increase in computational complexity. In addition, the existing method is a method of copying information of an intermediate frequency band to a high frequency band and adjusting an intensity of a spectrum of the copied high frequency band, and may cause a considerable deterioration of audio quality when a lot of tonal components are included in the intermediate frequency band.

Therefore, a technique for overcoming the above issues is needed.

SUMMARY

Example embodiments provide a method and apparatus for efficiently increasing a quality of a restored audio signal using a neural network model that restores an audio signal in consideration of both features of the audio signal in a low frequency band and features of the audio signal in a high frequency band.

According to an aspect, there is provided a method of encoding an audio signal, the method including identifying an input signal corresponding to a low frequency band of the audio signal, windowing the input signal, generating a first latent vector by inputting the windowed input signal to a first encoding model, transforming the windowed input signal into a frequency domain, generating a second latent vector by inputting the transformed input signal to a second encoding model, generating a final latent vector by combining the first latent vector and the second latent vector, and generating a bitstream corresponding to the final latent vector.

The first encoding model may be a neural network model trained based on a time domain difference between an output signal generated from the final latent vector and the audio signal and a frequency domain difference between the output signal and the audio signal.

The first encoding model may include a plurality of scale blocks for down-sampling and a convolution layer for performing a convolution operation.

According to an aspect, there is provided a method of decoding an audio signal, the method including identifying a bitstream generated by an encoder, extracting a latent vector from the bitstream, and generating an output signal by inputting the latent vector to a decoding model, wherein the latent vector may be a combination of a latent vector indicating a time domain feature of an input signal and a latent vector indicating a frequency domain feature of the input signal, and the input signal may be an audio signal included in a low frequency band of the audio signal.

The decoding model may be a neural network model trained based on a time domain difference between the output signal and the audio signal and a frequency domain difference between the output signal and the audio signal.

According to an aspect, there is provided a method of training neural network models used to encode and decode an audio signal, the method including windowing an input signal corresponding to a low frequency band of the audio signal, generating a first latent vector by inputting the windowed input signal to a first encoding model, transforming the windowed input signal into a frequency domain, generating a second latent vector by inputting the transformed input signal to a second encoding model, generating a final latent vector by combining the first latent vector and the second latent vector, generating an output signal by inputting the final latent vector to a decoding model, and training the first encoding model and the decoding model based on a time domain difference between the output signal and the audio signal and a frequency domain difference between the output signal and the audio signal.

The first encoding model may include a plurality of scale blocks for down-sampling and a convolution layer for performing a convolution operation.

According to an aspect, there is provided an encoder for performing a method of encoding an audio signal, the encoder including a processor, wherein the processor may be configured to identify an input signal corresponding to a low frequency band of the audio signal, window the input signal, generate a first latent vector by inputting the windowed input signal to a first encoding model, transform the windowed input signal into a frequency domain, generate a second latent vector by inputting the transformed input signal to a second encoding model, generate a final latent vector by combining the first latent vector and the second latent vector, and generate a bitstream corresponding to the final latent vector.

The first encoding model may be a neural network model trained based on a time domain difference between an output signal generated from the final latent vector and the audio signal and a frequency domain difference between the output signal and the audio signal.

The first encoding model may include a plurality of scale blocks for down-sampling and a convolution layer for performing a convolution operation.

According to an aspect, there is provided a decoder for performing a method of decoding an audio signal, the decoder including a processor, wherein the processor may be configured to identify a bitstream generated by an encoder, extract a latent vector from the bitstream, and generate an output signal by inputting the latent vector to a decoding model, wherein the latent vector may be a combination of a latent vector indicating a time domain feature of an input signal and a latent vector indicating a frequency domain feature of the input signal, and the input signal may be an audio signal included in a low frequency band of the audio signal.

The decoding model may be a neural network model trained based on a time domain difference between the output signal and the audio signal and a frequency domain difference between the output signal and the audio signal.

According to an aspect, there is provided an encoder for performing a method of training neural network models used to encode and decode an audio signal, the encoder including a processor, wherein the processor may be configured to window an input signal corresponding to a low frequency band of the audio signal, generate a first latent vector by inputting the windowed input signal to a first encoding model, transform the windowed input signal into a frequency domain, generate a second latent vector by inputting the transformed input signal to a second encoding model, generate a final latent vector by combining the first latent vector and the second latent vector, generate an output signal by inputting the final latent vector to a decoding model, and train the first encoding model and the decoding model based on a time domain difference between the output signal and the audio signal and a frequency domain difference between the output signal and the audio signal.

The first encoding model may include a plurality of scale blocks for down-sampling and a convolution layer for performing a convolution operation.

Additional aspects of example embodiments will be set forth in part in the description which follows and, in part, will be apparent from the description, or may be learned by practice of the disclosure.

According to example embodiments, it is possible to efficiently increase a quality of a restored audio signal using a neural network model that restores an audio signal in consideration of both features of the audio signal in a low frequency band and features of the audio signal in a high frequency band.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
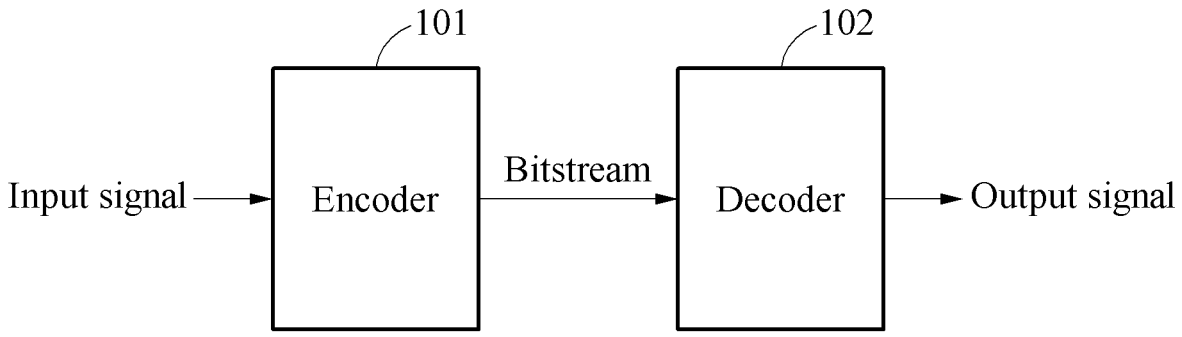
FIG. 1 illustrates an encoder and a decoder according to an example embodiment.

Hereinafter, example embodiments will be described in detail with reference to the accompanying drawings. However, various alterations and modifications may be made to the example embodiments. Here, the example embodiments are not construed as limited to the disclosure. The example embodiments should be understood to include all changes, equivalents, and replacements within the idea and the technical scope of the disclosure.

The terminology used herein is for the purpose of describing particular example embodiments only and is not to be limiting of the example embodiments. The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the example embodiments with reference to the accompanying drawings, like reference numerals refer to like constituent elements and a repeated description related thereto will be omitted. In the description of example embodiments, detailed description of well-known related structures or functions will be omitted when it is deemed that such description will cause ambiguous interpretation of the present disclosure.

FIG. 1 illustrates an encoder and a decoder according to an example embodiment.

The present disclosure provides a technique for expanding a band of an audio signal in consideration of both features of the audio signal in a low frequency band and features of the audio signal in a high frequency band, and efficiently increasing a quality of a restored audio signal using a neural network model that restores an audio signal.

The audio signal encoding and decoding methods provided herein may be performed by an encoder 101 and a decoder 102, respectively. The encoder 101 and the decoder 102 may each include a processor. The encoder 101 and the decoder 102 may be the same electronic device. The processor included in the encoder 101 and the processor included in the decoder 102 may perform an encoding method, a decoding method, and a method of training a neural network model according to various example embodiments.

Referring to FIG. 1, the encoder 101 may generate a bitstream by encoding an input signal, and the decoder 102 may receive the bitstream and generate an output signal by decoding the bitstream. The input signal may be an audio signal corresponding to a low frequency band in an original audio signal, and the output signal may be an audio signal restored by the decoder 102. The decoder 102 may restore not only a low-band signal of the audio signal but also a high frequency band of the audio signal.

Figure 5A:
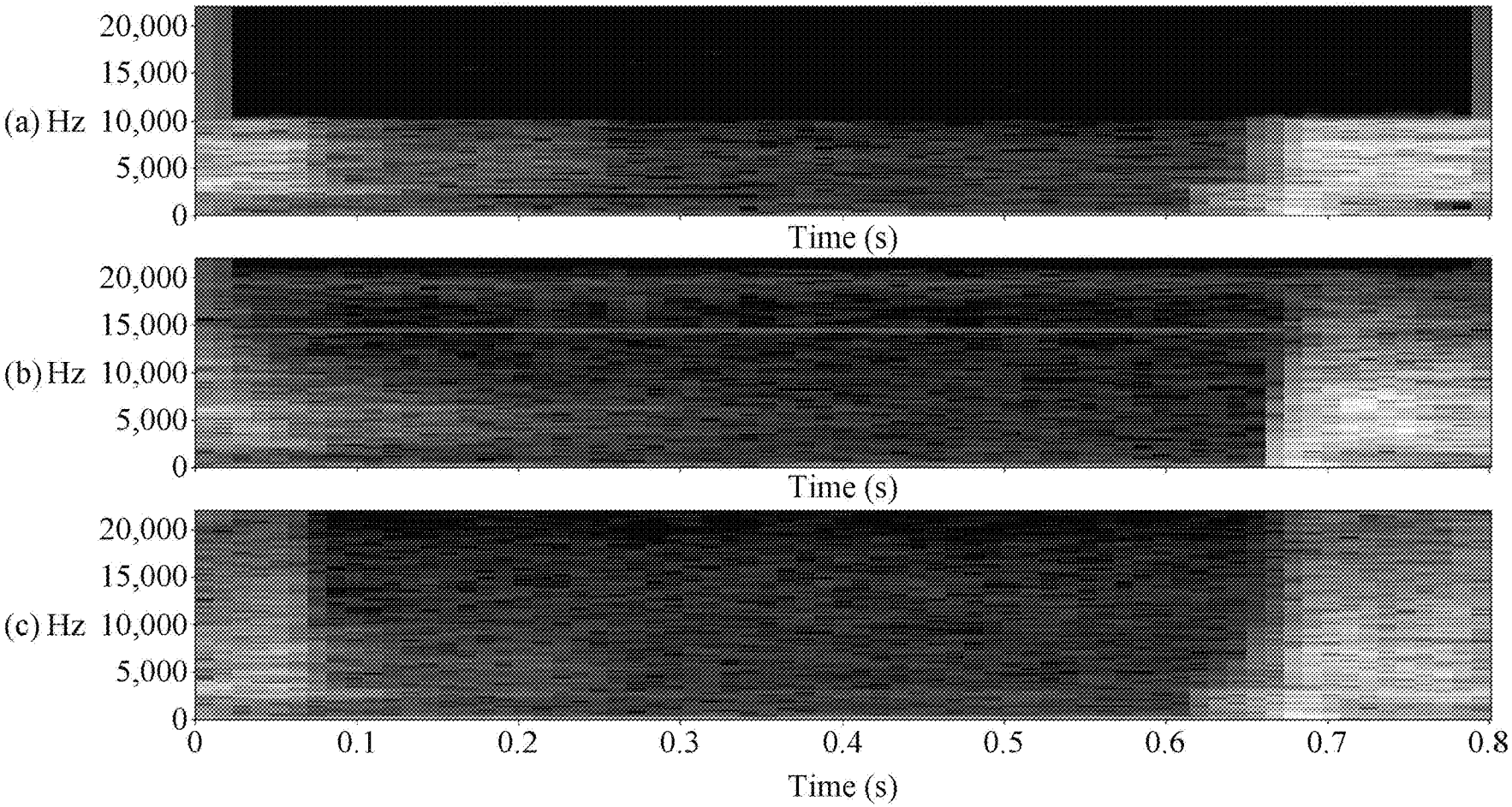
FIGS. 5A to 5C illustrate spectrograms of an input signal, an original audio signal, and an output signal according to an example embodiment.
Figure 5B:
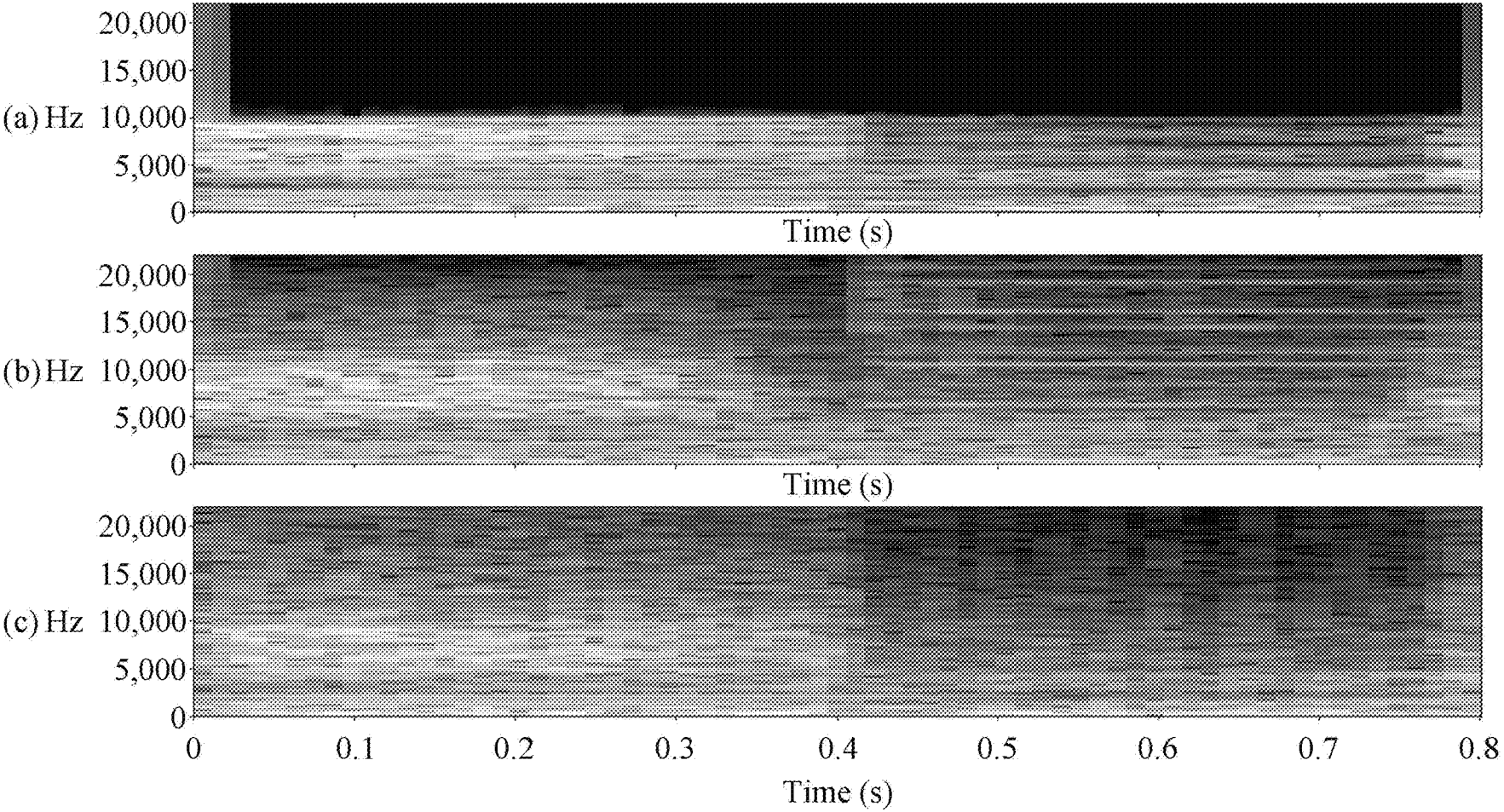
Figure 5C:
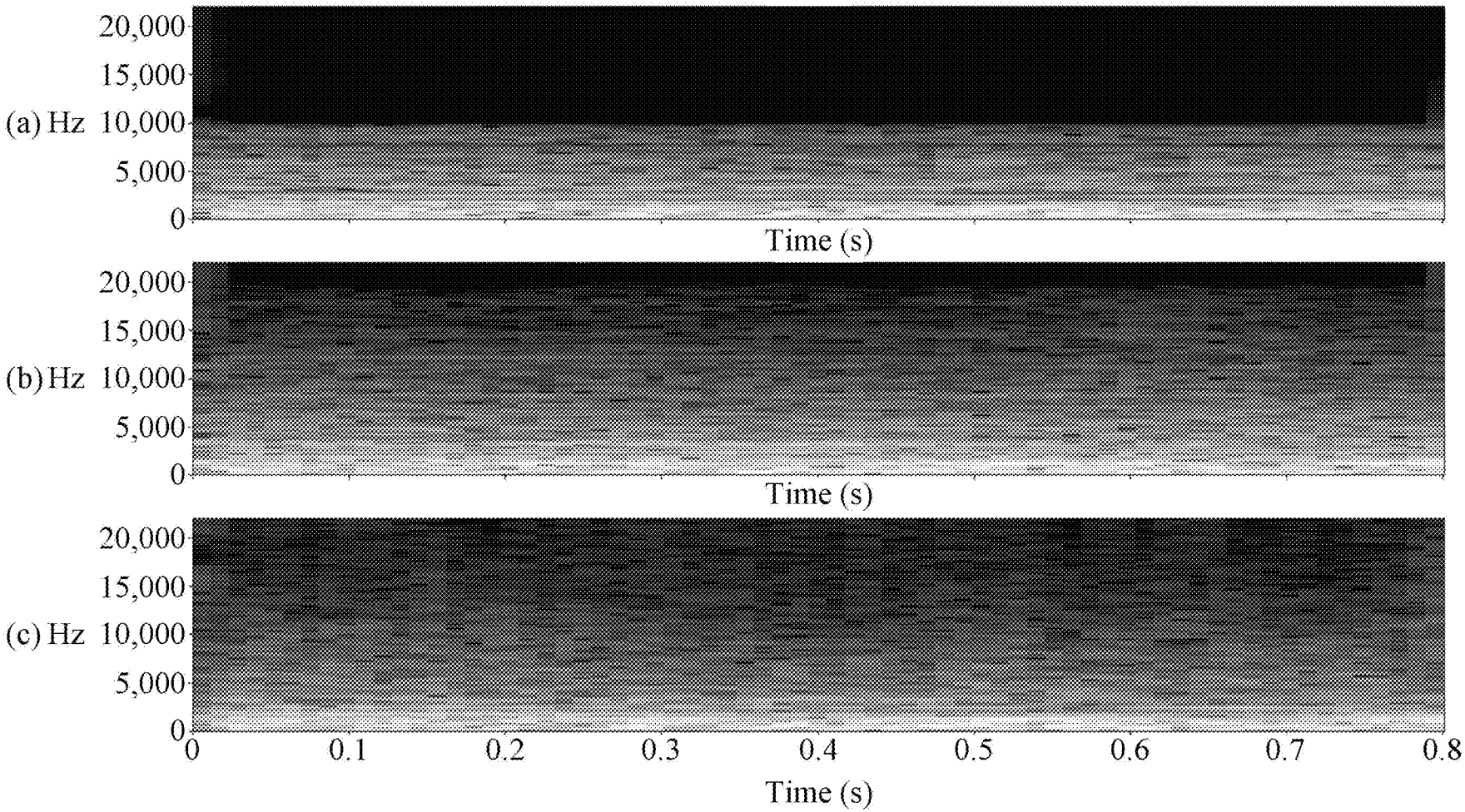

A low frequency band may be determined in consideration of human auditory characteristics and is not limited to a specific example. (a) in FIGS. 5A, 5B, and 5C shows a spectrogram of the input signal.

A neural network model according to an example embodiment may include an input layer for receiving input data for the neural network model, hidden layers for processing an operation on the input data, and an output layer for outputting output data of the neural network model. A hidden layer may include a plurality of scale blocks for down-sampling and a convolution layer for performing a convolution operation. The hidden layer may include a plurality of weights.

As an example, the neural network model may include an encoding model and a decoding model, like an autoencoder. The encoding model may generate a latent vector by encoding an input signal. The encoding model may be trained to generate a latent vector by encoding an input signal.

The decoding model may generate an output signal by decoding the latent vector. The decoding model may be trained to generate an output signal by decoding a latent vector. All operations processed by the neural network model may be performed by a processor included in the encoder 101 or the decoder 102.

The encoding model may generate the latent vector by extracting features of the input signal. The latent vector may include the features of the input signal. The encoding model may extract the latent vector by performing a convolution operation on a windowed input signal.

The encoding model and the decoding model may include various types of neural network models or machine learning models, such as a convolutional neural network, a recurrent neural network, and the like, and are not limited to specific examples. Detailed encoding and decoding processes according to an example embodiment will be described later with reference to FIG. 2.

The encoding model and the decoding model may be trained based on a time domain difference between the output signal and the original audio signal and a frequency domain difference between the output signal and the original audio signal.

Figure 2:
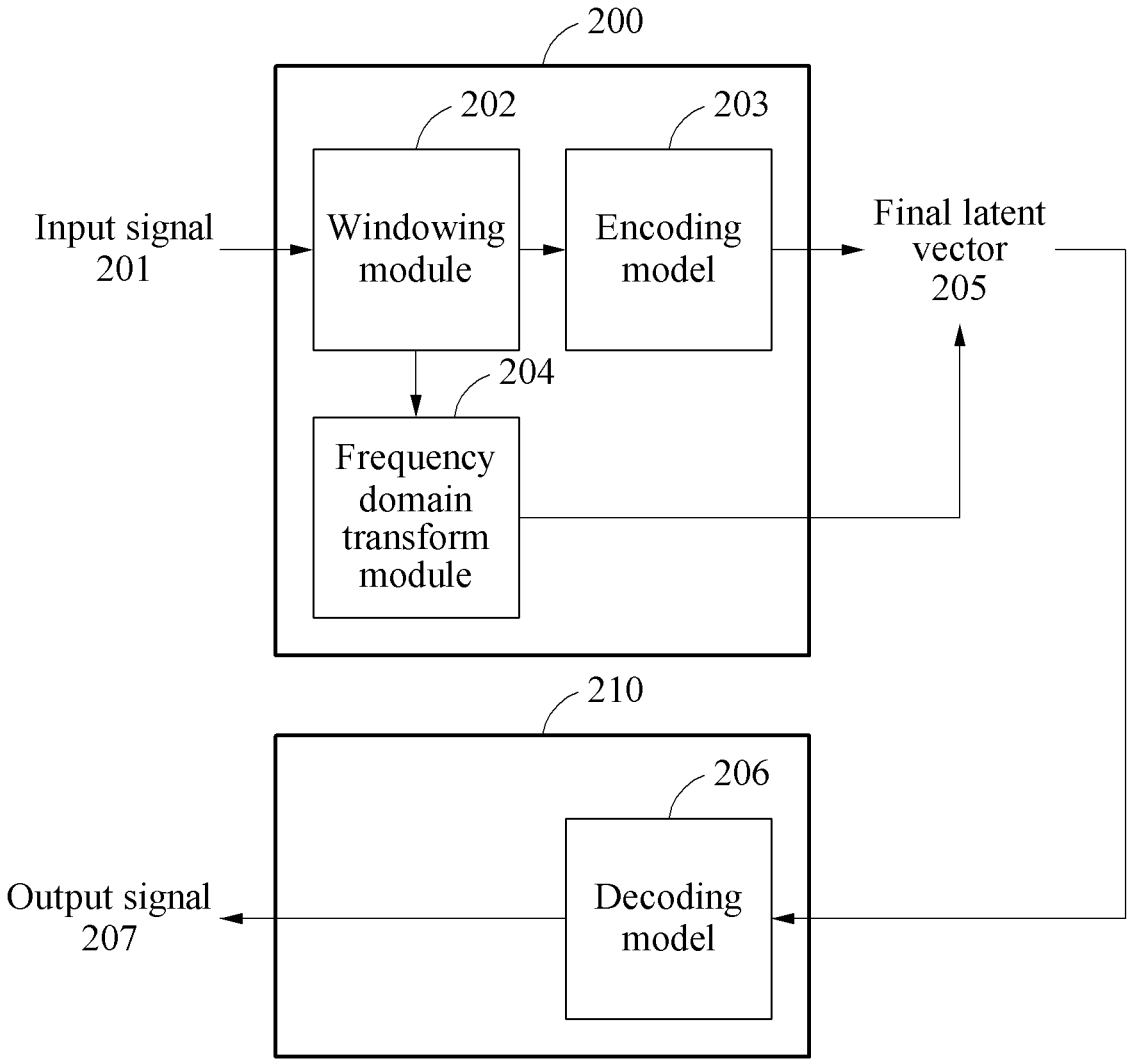
FIG. 2 is a block diagram illustrating encoding and decoding processes according to an example embodiment.

FIG. 2 is a block diagram illustrating encoding and decoding processes according to an example embodiment.

An encoder 200 may include a windowing module 202, a frequency domain transform module 204, and an encoding model 203. All operations processed by the windowing module 202, the frequency domain transform module 204, and the encoding model 203 may be performed by a processor included in the encoder 200.

The encoder 200 may identify an input signal 201 corresponding to a low frequency band of an original audio signal. The windowing module 202 may window the input signal 201. For example, Rect, Hann, Hamming, and Blackman windows may be used to window the input signal 201 including a plurality of frames. Input data for the encoding model 203 may be the windowed input signal 201. Output data of the encoding model 203 may be a first latent vector.

The first latent vector may be a latent vector including a time domain feature of the input signal 201. The encoder 200 may generate the first latent vector by inputting the windowed input signal 201 to the encoding model 203.

The frequency domain transform module 204 may transform the windowed input signal 201 into a frequency domain. For example, a Fourier transform may be used for the transformation into the frequency domain. For example, the frequency domain transform module 204 may transform the windowed input signal 201 into the frequency domain using a fast Fourier transform.

The frequency domain transform module 204 may generate a second latent vector by inputting the transformed input signal 201 to an encoding model. The encoding model may be defined as a second encoding model 203 and is not included in the neural network model used herein. The encoding model 203 included in the neural network model may be defined as a first encoding model 203. The second latent vector may be a latent vector including a frequency domain feature of the input signal 201.

For example, a recurrent neural network model may be used as the second encoding model 203. For example, a long short-term memory (LSTM) model based on a recurrent neural network may be used as the second encoding model 203. The second encoding model 203 may generate the second latent vector by extracting features of the input signal 201 transformed into the frequency domain. The second encoding model 203 may be pre-trained to generate a second latent vector by extracting features of an input signal 201 transformed into a frequency domain.

The encoder 200 may combine the first latent vector and the second latent vector. For example, the encoder 200 may generate a final latent vector 205 by concatenating the first latent vector and the second latent vector. The encoder 200 may transform the final latent vector 205 into a bitstream. The encoder 200 may generate a bitstream corresponding to the final latent vector 205.

The decoder 210 may identify the bitstream generated by the encoder 200. The decoder 210 may extract the final latent vector 205 from the bitstream. The decoder 210 may generate an output signal 207 by inputting the final latent vector 205 to a neural network model. Specifically, the decoder 210 may generate the output signal 207 by inputting the final latent vector 205 to a decoding model 206 of the neural network model. The decoding model 206 may generate the output signal 207 by restoring an audio signal of a high frequency band from the final latent vector 205.

Figure 3:
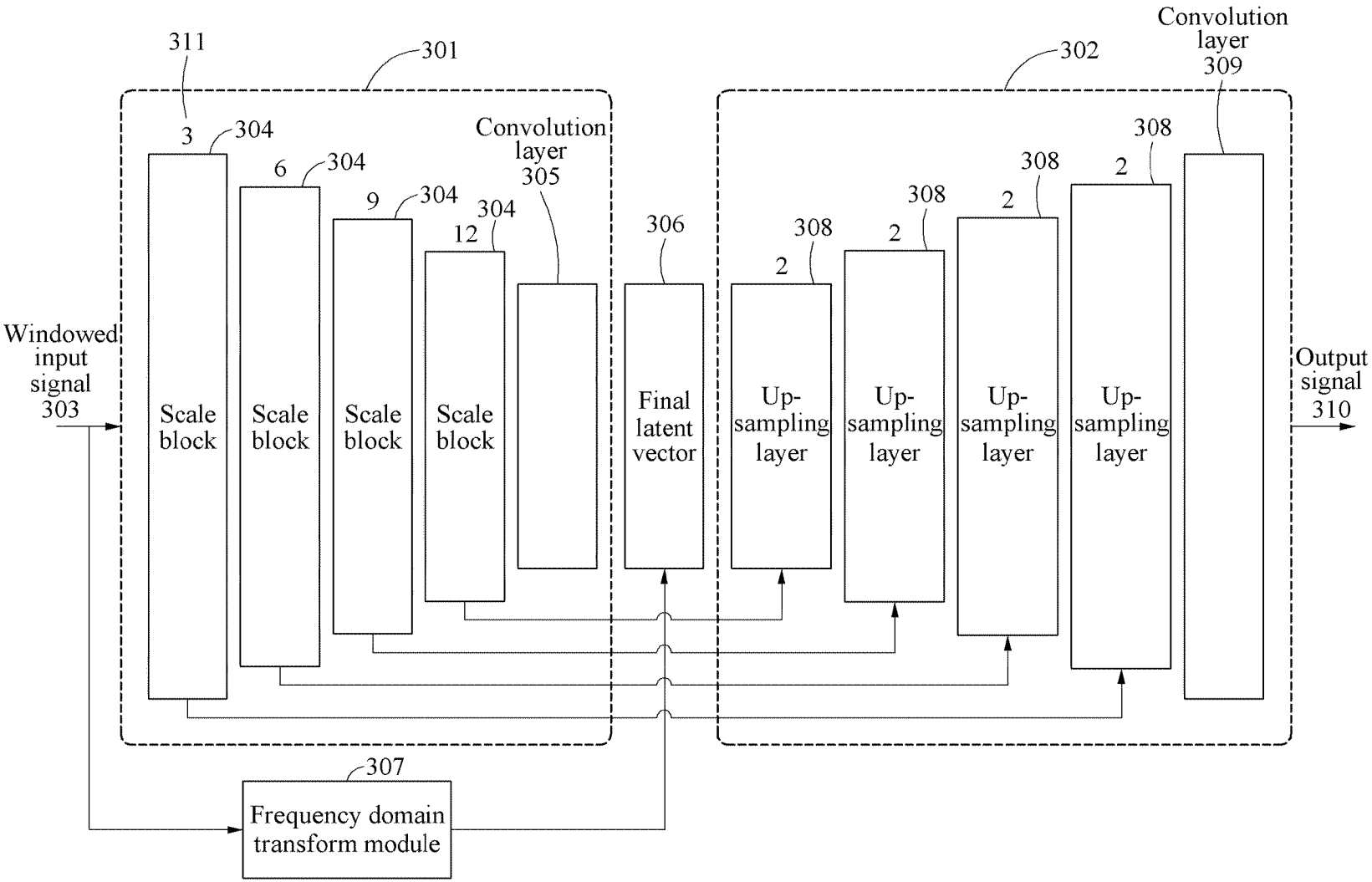
FIG. 3 is a block diagram illustrating a structure of a neural network model according to an example embodiment.

FIG. 3 is a block diagram illustrating a structure of a neural network model according to an example embodiment.

A neural network model may include a first encoding model 301 and a decoding model 302. Input data for the first encoding model 301 may be a windowed input signal 303, and output data thereof may be a first latent vector.

An encoder may generate a final latent vector 306 by concatenating a second latent vector generated by a frequency domain transform module 307 and the first latent vector. Input data for the decoding model 302 may be the final latent vector 306, and output data thereof may be an output signal 310.

The first encoding model 301 may include a plurality of scale blocks 304 and a convolution layer 305. As an example, the convolution layer 305 may perform a one-dimensional convolution operation. A scale block 304 may generate output data by down-sampling input data.

Input data for a scale block 304 may be output data generated by a previous scale block 304. As an example, the scale block 304 may down-sample the input data by one half. The scale block 304 may include convolution layers corresponding to a plurality of paths.

For example, the scale block 304 may generate the output data by performing a convolution operation using N parallel convolution layers and combining operation results. N is an arbitrary natural number. A specific structure of the scale block 304 will be described later with reference to FIG. 4.

The decoding model 302 may include a plurality of up-sampling layers 308 for up-sampling and a convolution layer 309 for performing a convolution operation. For example, the up-sampling layers 308 may up-sampling the final latent vector 306 by performing a transposed convolution operation or performing a pixel shuffle algorithm operation. For example, the up-sampling layers 308 may reduce the dimension of the input data and increase the length of the input data. As an example, the up-sampling layers 308 may be implemented by transposed convolution and pixel shuffling.

The up-sampling layers 308 and the scale blocks 304 may have a one-to-one correspondence. The number of up-sampling layers 308 and the number of scale blocks 304 may be the same. Accordingly, since the up-sampling layers 308 and the scale blocks 304 have a one-to-one correspondence, the magnitude of the input signal 303 and the magnitude of the output signal 310 may be the same.

Figure 4:
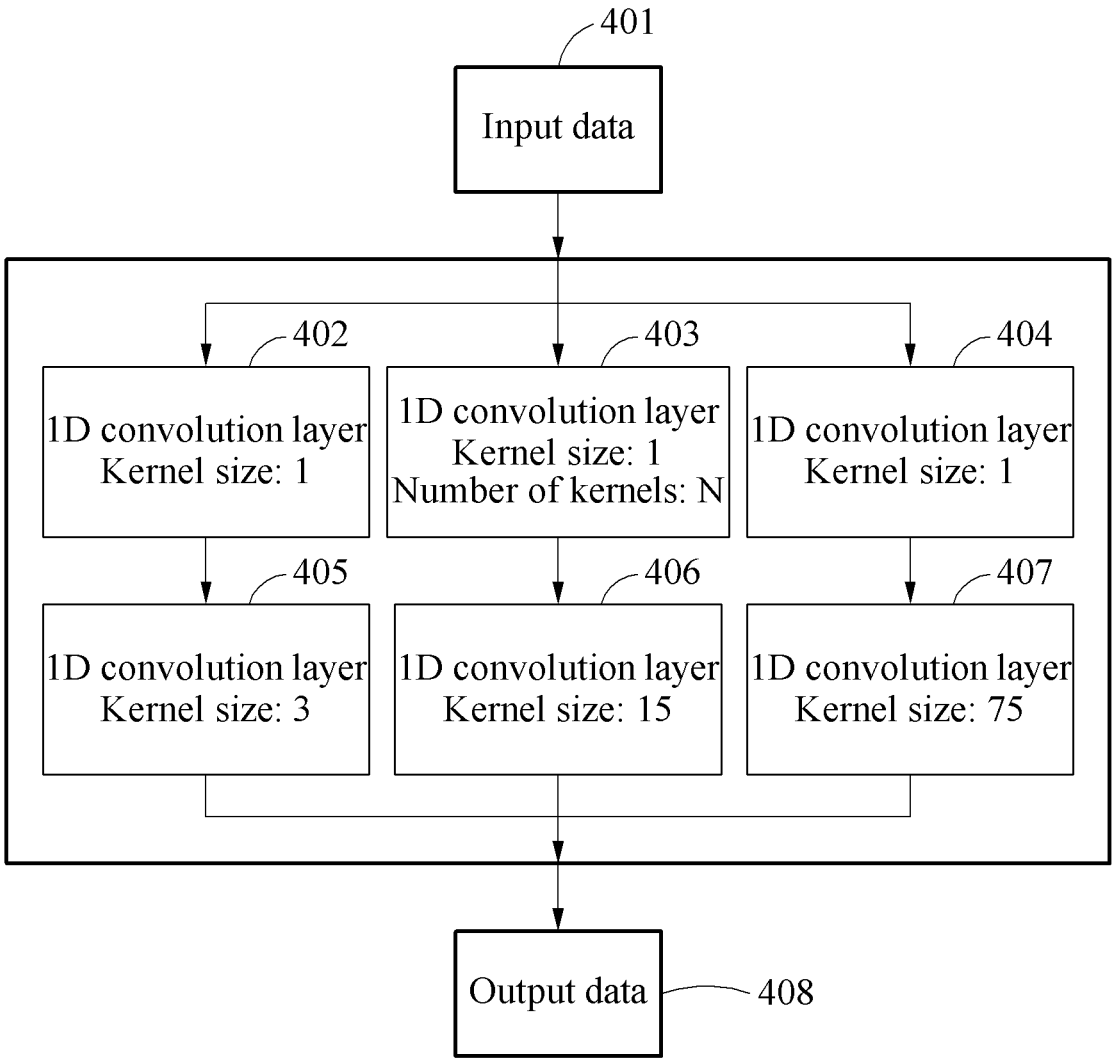
FIG. 4 illustrates a structure of a scale block according to an example embodiment.

FIG. 4 illustrates a structure of a scale block according to an example embodiment.

Referring to FIG. 4, a scale block may include three parallel one-dimensional convolution layers 402, 403, and 404. The scale block may generate output data 408 by processing input data 401 along three paths and combining processed results. Referring to FIG. 4, the scale block may further include convolution layers 405, 406, and 407 having different kernel sizes (e.g., 3, 15, and 75) for the respective paths. The size of input data for the scale block may be determined according to a batch size.

The kernel size of the convolution layers 402, 403, and 404 corresponding to the respective paths may be determined to be "1". However, operation results obtained by the convolution layers 402, 403, 404 in the respective paths may be used as input data 401 for the convolution layers 405, 406, 407 having different kernel sizes (e.g., 3, 15, and 75). A channel 311 for output data output according to each path in a scale block may be predetermined.

For example, for a scale block in which channel 311 for the output data is determined to be "3", a channel for output data determined according to each path may be determined to be "3". In the case of FIG. 4, since three paths are used, a channel for final output data 408 may be determined to be "9".

The output data 408 determined according to each path may be combined through concatenation. The scale block may extract features of a windowed input signal in consideration of a small receptive field as well as a large receptive field by performing a convolution operation using the convolution layers 405, 406, and 407 having different kernel sizes. The scale block may down-sample the length of the windowed input signal by a factor of 1/k and increase the dimension by a factor of k. k may be determined differently according to an example embodiment.

FIGS. 5A to 5C illustrate spectrograms of an input signal, an original audio signal, and an output signal according to an example embodiment.

(a) in FIGS. 5A to 5C may be a spectrogram of an input signal windowed with the unit of 0.1 seconds. (b) in FIGS. 5A to 5C may be a spectrogram of an original audio signal windowed with the unit of 0.1 seconds. (a) in FIGS. 5A to 5C may be a spectrogram of an audio signal included in a low frequency band in the original audio signal.

The input signal shown in (a) of FIGS. 5A to 5C may be an audio signal having a limited high frequency band. (c) in FIGS. 5A to 5C may be a spectrogram of an output signal windowed with the unit of 0.1 seconds.

Figure 6:
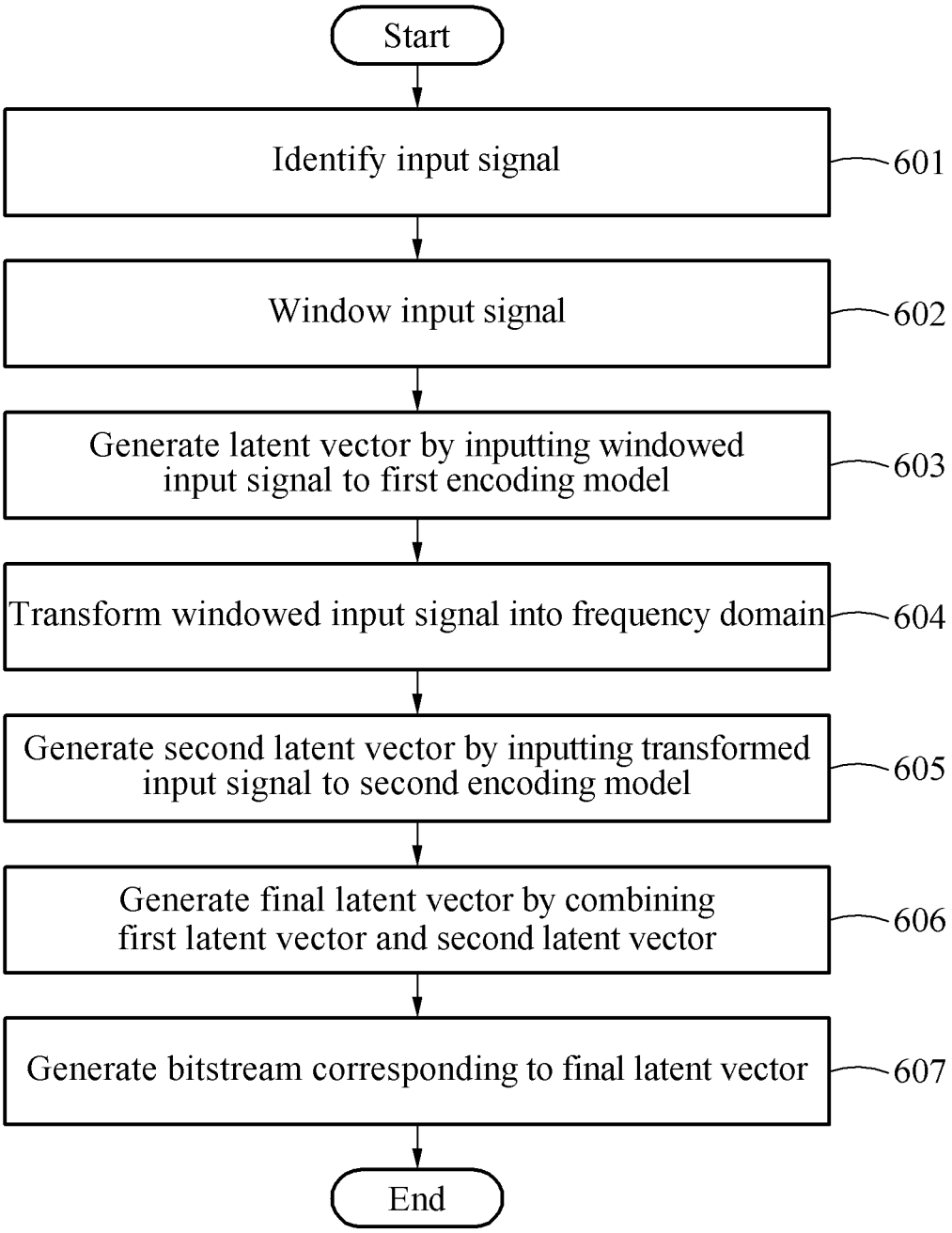
FIG. 6 is a flowchart illustrating an encoding method according to an example embodiment.

FIG. 6 is a flowchart illustrating an encoding method according to an example embodiment.

In operation 601, an encoder may identify an input signal corresponding to a low frequency band of an audio signal. In operation 602, the encoder may window the input signal. In operation 603, the encoder may generate a first latent vector by inputting the windowed input signal to a first encoding model. In operation 604, the encoder may transform the windowed input signal into a frequency domain.

In operation 605, the encoder may generate a second latent vector by inputting the transformed input signal to a second encoding model. In operation 606, the encoder may generate a final latent vector by combining the first latent vector and the second latent vector. In operation 607, the encoder may generate a bitstream corresponding to the final latent vector.

Figure 7:
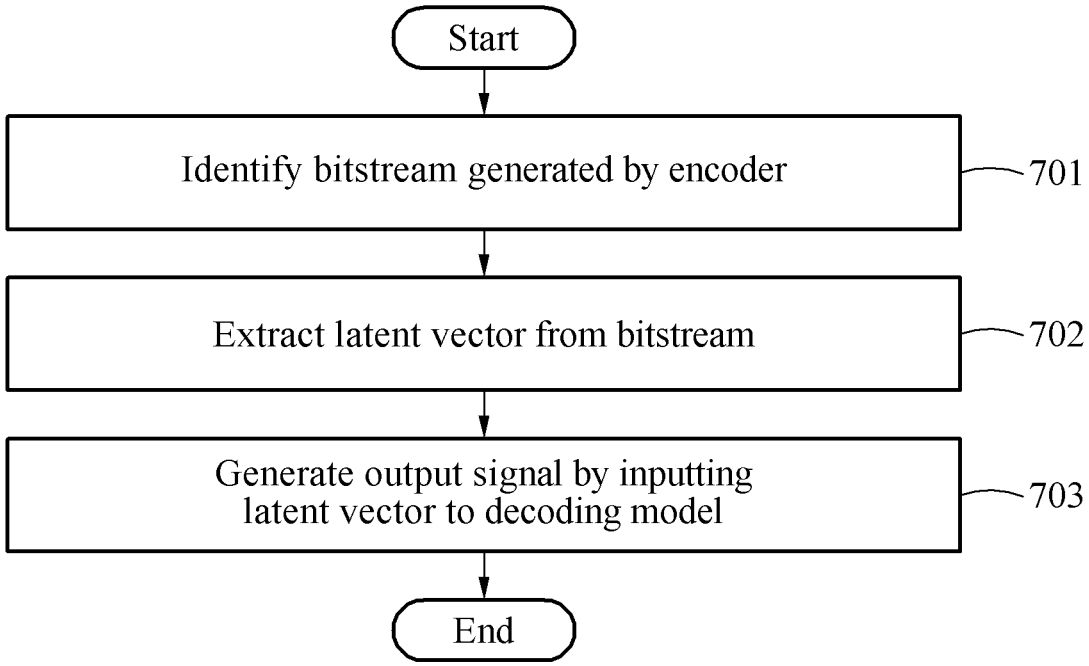
FIG. 7 is a flowchart illustrating a decoding method according to an example embodiment.

FIG. 7 is a flowchart illustrating a decoding method according to an example embodiment.

In operation 701, a decoder may identify a bitstream generated by an encoder. In operation 702, the decoder may extract a latent vector from the bitstream. In operation 703, the decoder may generate an output signal by inputting the latent vector to a decoding model.

Figure 8:
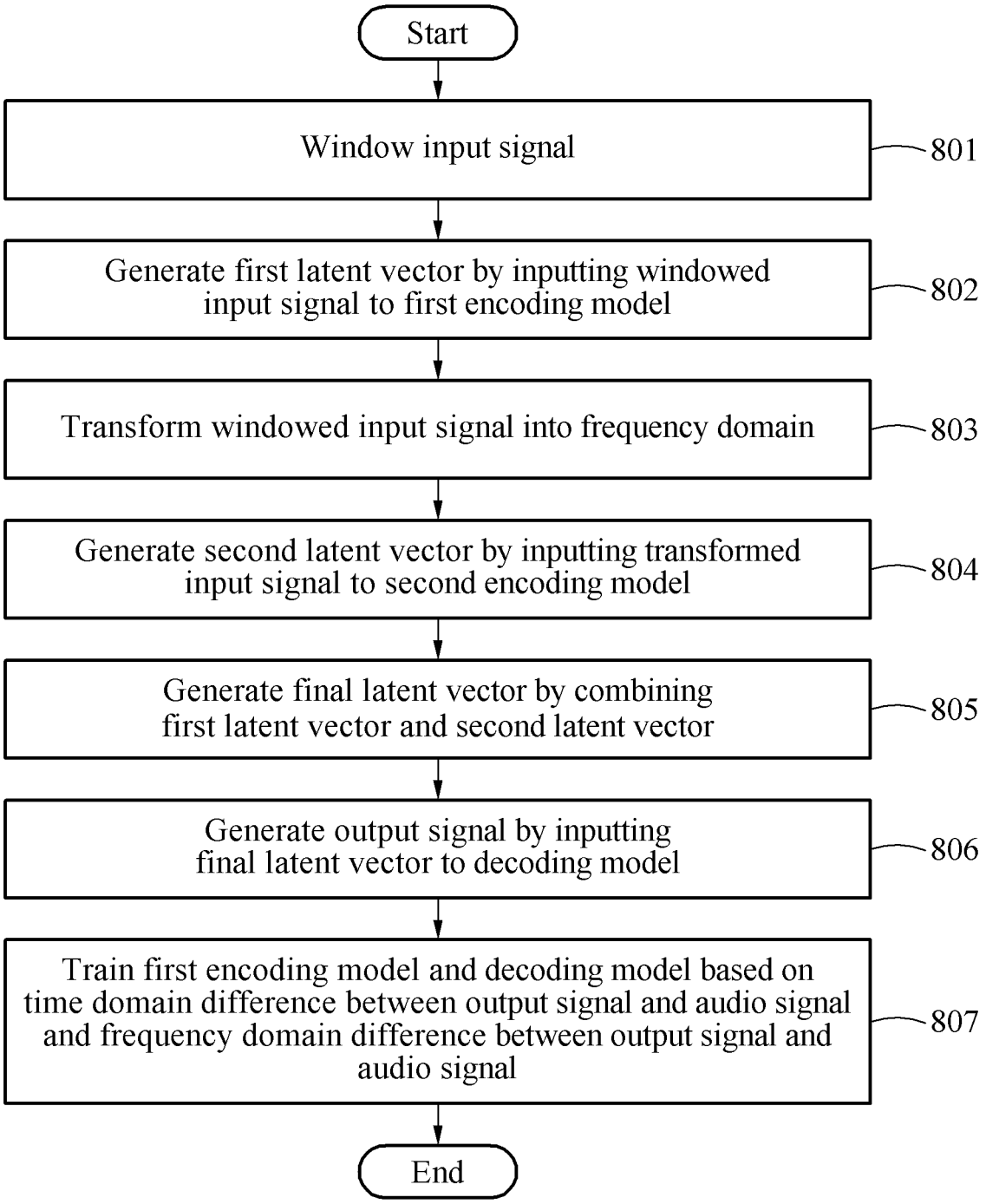
FIG. 8 is a flowchart illustrating a method of training a neural network model according to an example embodiment.

FIG. 8 is a flowchart illustrating a training method according to an example embodiment.

In operation 801, an encoder or a decoder may window an input signal corresponding to a low frequency band of an audio signal. In operation 802, the encoder or the decoder may generate a first latent vector by inputting the windowed input signal to a first encoding model.

In operation 803, the encoder or the decoder may transform the windowed input signal into a frequency domain. In operation 804, the encoder or the decoder may generate a second latent vector by inputting the transformed input signal to a second encoding model.

In operation 805, the encoder or the decoder may generate a final latent vector by combining the first latent vector and the second latent vector. In operation 806, the encoder or the decoder may generate an output signal by inputting the final latent vector to a decoding model.

In operation 807, the encoder or the decoder may train the first encoding model and the decoding model based on a time domain difference between the output signal and the audio signal and a frequency domain difference between the output signal and the audio signal.

The encoder or the decoder may determine a loss value in a time domain based on the time domain difference between the output signal and the audio signal. The encoder or the decoder may determine a loss value in a frequency domain based on the frequency domain difference between the output signal and the audio signal.

For example, the encoder or the decoder may determine a first loss value based on the time domain difference between the output signal and the audio signal using Equation 1 below. The first loss value may be the loss value in the time domain.

$$Et = \frac{1}{N}\sum_{i}^{N}|y_i - \hat{y}_i| \quad \text{[Equation 1]}$$

In Equation 1, Et may denote the first loss value. N may denote the total length of the original audio signal in a windowed area. i may denote an index of a frame. $y_i$ may denote an i-th frame of the original audio frame, and $\hat{y}_i$ may denote an i-th frame of the output signal.

That is, the encoder or the decoder may determine the first loss value for the time domain difference between the output signal and the audio signal using a mean absolute error.

$$Ef = \frac{1}{M}\sum_{i}^{M}|Y_i - \hat{Y}_i| \quad \text{[Equation 2]}$$

In Equation 2, Ef may denote a second loss value. M may denote the total length of the original audio signal in the windowed area. i may denote an index of a frame. Yi may denote an i-th frame of the original audio signal transformed into the frequency domain, and $\hat{Y}_i$ may denote an i-th frame of the output signal transformed into the frequency domain.

That is, the encoder or the decoder may determine the second loss value for the frequency domain difference between the output signal and the audio signal using a spectral distance.

The encoder or the decoder may update weights of the first encoding model and the decoding model so that the time domain difference between the output signal and the audio signal may be minimized. As another example, the encoder or the decoder may update the weights of the first encoding model and the decoding model so that the frequency domain difference between the output signal and the audio signal may be minimized.

As another example, the encoder or the decoder may update the weights of the first encoding model and the decoding model so that a sum of the time domain difference between the output signal and the audio signal and the frequency domain difference between the output signal and the audio signal may be minimized.

For example, the encoder or the decoder may update the weights of the first encoding model and the decoding model so that a weighted sum of the time domain difference between the output signal and the audio signal and the frequency domain difference between the output signal and the audio signal may be minimized. As an example, a backpropagation scheme may be used to train the first encoding model and the decoding model based on the loss values.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

The method according to example embodiments may be written in a computer-executable program and may be implemented as various recording media such as magnetic storage media, optical reading media, or digital storage media.

Various techniques described herein may be implemented in digital electronic circuitry, computer hardware, firmware, software, or combinations thereof. The implementations may be achieved as a computer program product, for example, a computer program tangibly embodied in a machine readable storage device (a computer-readable medium) to process the operations of a data processing device, for example, a programmable processor, a computer, or a plurality of computers or to control the operations. A computer program, such as the computer program(s) described above, may be written in any form of a programming language, including compiled or interpreted languages, and may be deployed in any form, including as a stand-alone program or as a module, a component, a subroutine, or other units suitable for use in a computing environment. A computer program may be deployed to be processed on one computer or multiple computers at one site or distributed across multiple sites and interconnected by a communication network.

Processors suitable for processing of a computer program include, by way of example, both general and special purpose microprocessors, and any one or more processors of any kind of digital computer. Generally, a processor will receive instructions and data from a read-only memory or a random-access memory, or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Examples of information carriers suitable for embodying computer program instructions and data include semiconductor memory devices, e.g., magnetic media such as hard disks, floppy disks, and magnetic tape, optical media such as compact disk read only memory (CD-ROM) or digital video disks (DVDs), magneto-optical media such as floptical disks, read-only memory (ROM), random-access memory (RAM), flash memory, erasable programmable ROM (EPROM), or electrically erasable programmable ROM (EEPROM). The processor and the memory may be supplemented by, or incorporated in special purpose logic circuitry.

In addition, non-transitory computer-readable media may be any available media that may be accessed by a computer and may include both computer storage media and transmission media.

Although the present specification includes details of a plurality of specific example embodiments, the details should not be construed as limiting any invention or a scope that can be claimed, but rather should be construed as being descriptions of features that may be peculiar to specific example embodiments of specific inventions. Specific features described in the present specification in the context of individual example embodiments may be combined and implemented in a single example embodiment. On the contrary, various features described in the context of a single embodiment may be implemented in a plurality of example embodiments individually or in any appropriate sub-combination. Furthermore, although features may operate in a specific combination and may be initially depicted as being claimed, one or more features of a claimed combination may be excluded from the combination in some cases, and the claimed combination may be changed into a sub-combination or a modification of the sub-combination.

Likewise, although operations are depicted in a specific order in the drawings, it should not be understood that the operations must be performed in the depicted specific order or sequential order or all the shown operations must be performed in order to obtain a preferred result. In specific cases, multitasking and parallel processing may be advantageous. In a specific case, multitasking and parallel processing may be advantageous. In addition, it should not be understood that the separation of various device components of the aforementioned example embodiments is required for all the example embodiments, and it should be understood that the aforementioned program components and apparatuses may be integrated into a single software product or packaged into multiple software products.

The example embodiments disclosed in the present specification and the drawings are intended merely to present specific examples in order to aid in understanding of the present disclosure, but are not intended to limit the scope of the present disclosure. It will be apparent to those skilled in the art that various modifications based on the technical spirit of the present disclosure, as well as the disclosed example embodiments, can be made.

What is claimed is:

1. A method of encoding an audio signal, the method comprising:

identifying an input signal corresponding to a low frequency band of the audio signal;

windowing the input signal;

generating a first latent vector by inputting the windowed input signal to a first encoding model;

transforming the windowed input signal into a frequency domain;

generating a second latent vector by inputting the transformed input signal to a second encoding model;

generating a final latent vector by combining the first latent vector and the second latent vector; and generating a bitstream corresponding to the final latent vector, wherein the first encoding model is a neural network model trained based on a time domain difference between an output signal generated from the final latent vector and the audio signal and a frequency domain difference between the output signal and the audio signal.

2. The method of claim 1, wherein the first encoding model comprises a plurality of scale blocks for downsampling and a convolution layer for performing a convolution operation.

3. A method of decoding an audio signal, the method comprising:

identifying a bitstream generated by an encoder;

extracting a latent vector from the bitstream; and generating an output signal by inputting the latent vector to a decoding model, wherein the latent vector is a combination of a latent vector indicating a time domain feature of an input signal and a latent vector indicating a frequency domain feature of the input signal, and the input signal is an audio signal included in a low frequency band of the audio signal, wherein the decoding model is a neural network model trained based on a time domain difference between the output signal and the audio signal and a frequency domain difference between the output signal and the audio signal.

4. A method of training neural network models used to encode and decode an audio signal, the method comprising:

windowing an input signal corresponding to a low frequency band of the audio signal;

generating a first latent vector by inputting the windowed input signal to a first encoding model;

transforming the windowed input signal into a frequency domain;

generating a second latent vector by inputting the transformed input signal to a second encoding model;

generating a final latent vector by combining the first latent vector and the second latent vector;

generating an output signal by inputting the final latent vector to a decoding model; and training the first encoding model and the decoding model based on a time domain difference between the output signal and the audio signal and a frequency domain difference between the output signal and the audio signal.

5. The method of claim 4, wherein the first encoding model comprises a plurality of scale blocks for downsampling and a convolution layer for performing a convolution operation.

* * * * *